US006397502B1

(12) United States Patent
Chen

(10) Patent No.: US 6,397,502 B1
(45) Date of Patent: Jun. 4, 2002

(54) SAFETY STRUCTURE OF STEAM IRONING MACHINE

(75) Inventor: Hsi-Fu Chen, Changhua (TW)

(73) Assignee: Mitco International Ltd., Taipei Hsien (TW)

( * ) Notice: Subject to any disclaimer, the term of this patent is extended or adjusted under 35 U.S.C. 154(b) by 0 days.

(21) Appl. No.: 09/802,891

(22) Filed: Mar. 12, 2001

(51) Int. Cl.[7] ..... D06F 75/14

(52) U.S. Cl. ..... 38/77.8; 38/77.7

(58) Field of Search ..... 38/77.3, 77.6, 38/77.7, 77.8, 77.81, 77.83; 392/386, 394, 400, 401, 402, 403, 404, 405; 219/227, 250

(56) References Cited

U.S. PATENT DOCUMENTS

| | | | | | |
|---|---|---|---|---|---|
| 2,669,643 | A | * | 2/1954 | Johnson | 38/77.7 |
| 2,883,778 | A | * | 4/1959 | Kistner | 38/77.83 |
| 5,189,726 | A | * | 2/1993 | Pan | 38/77.6 |
| 5,329,709 | A | * | 7/1994 | Perez et al. | 38/77.7 |
| 6,067,403 | A | * | 5/2000 | Morgandi | 38/77.6 |

* cited by examiner

*Primary Examiner*—Ismael Izaguirre
(74) *Attorney, Agent, or Firm*—Browdy and Neimark

(57) ABSTRACT

A safety structure of a steam ironing machine is formed of a main body, a boiler disposed in the main body for generating steam, and a water tank set disposed in the main body and formed of a water storage tank and a water level safety device for activating and deactivating the steam ironing machine on the basis of the water level in the water storage tank.

4 Claims, 4 Drawing Sheets

SAFETY STRUCTURE OF STEAM IRONING MACHINE

FIELD OF THE INVENTION

The present invention relates generally to a steam ironing machine, and more particularly to a safety structure of the steam ironing machine.

BACKGROUND OF THE INVENTION

As shown in FIG. 1, a steam ironing machine of the prior art comprises a main body 1, a water tank 2 located in the main body 1, and a boiler 3 disposed in the main body 1. The boiler 3 is provided with a temperature controller 5 capable of automatic interruption of power supply at the time when the temperature of the boiler 3 has reached a predetermined degree. The boiler 3 is connected with the water tank 2 by a rubber tube 4 via which the water in the water tank 2 flows into the boiler 3. The steam is generated by the boiler 3.

Such prior art steam ironing machine as described above is defective in design in that the power supply is controlled by the temperature controller 5 of the boiler 3, which is vulnerable to malfunction or breakdown. In addition, the water tank 2 is not provided with a device to indicate the level of water in the water tank 2. As a result, the machine operator is not alerted to add water to the empty water tank 2. Under such a circumstance, the boiler 3 in operation is susceptible to explosion. In other words, the prior art steam ironing machine is in fact a safety hazard.

SUMMARY OF THE INVENTION

The primary objective of the present invention is to provide a steam ironing machine with a safety structure capable of controlling the operation of the steam ironing machine on the basis of the water level of the water tank of the steam ironing machine.

The present invention comprises a main body, a boiler, and a water tank set. The main body has a receiving slot in which the boiler and the water tank set are disposed. The boiler is used to generate steam for use in pressing. The water tank set has a water storage tank and a water level safety device comprising a base rod, a support rod, and a valve switch. The base rod is connected to the water storage tank. The support rod is pivotally fastened with the base rod. The support rod is provided at one end with a floating cylinder, and at other end with a push rod. The valve switch is disposed under the push rod and is serially connected with a circuit. When the water level in the water storage tank is higher than the floating cylinder, the floating cylinder is raised to force down the push rod, which comes in contact with the valve switch. As a result, the steam ironing machine is put into operation. When the water level in the water storage tank is lower than the floating cylinder, the push rod is raised to move away from the valve switch, thereby resulting in power interruption.

DETAILED DESCRIPTION OF THE INVENTION

Figure 1:
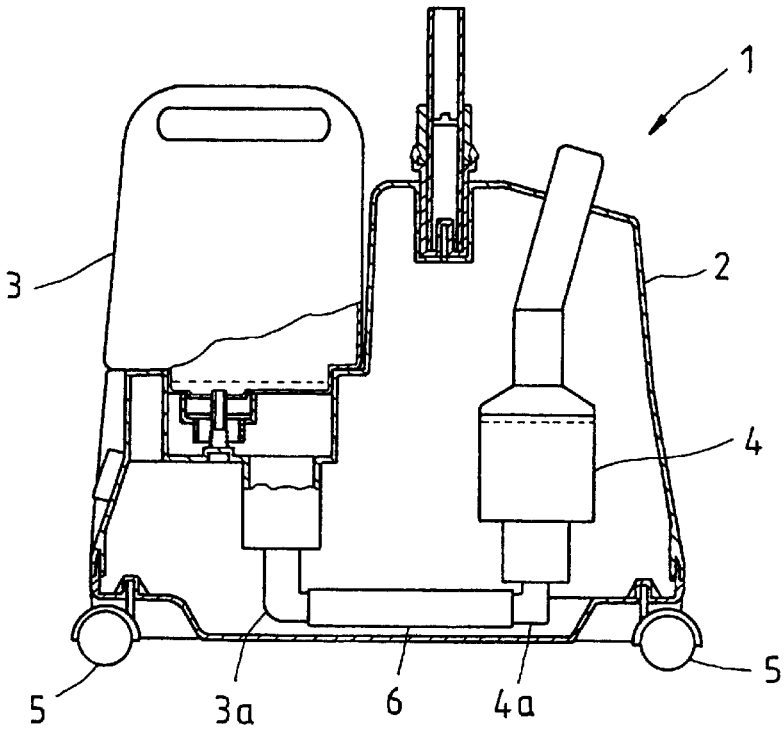
FIG. 1 PRIOR ART
FIG. 1 shows a sectional schematic view of a steam ironing machine of the prior art.
Figure 2:
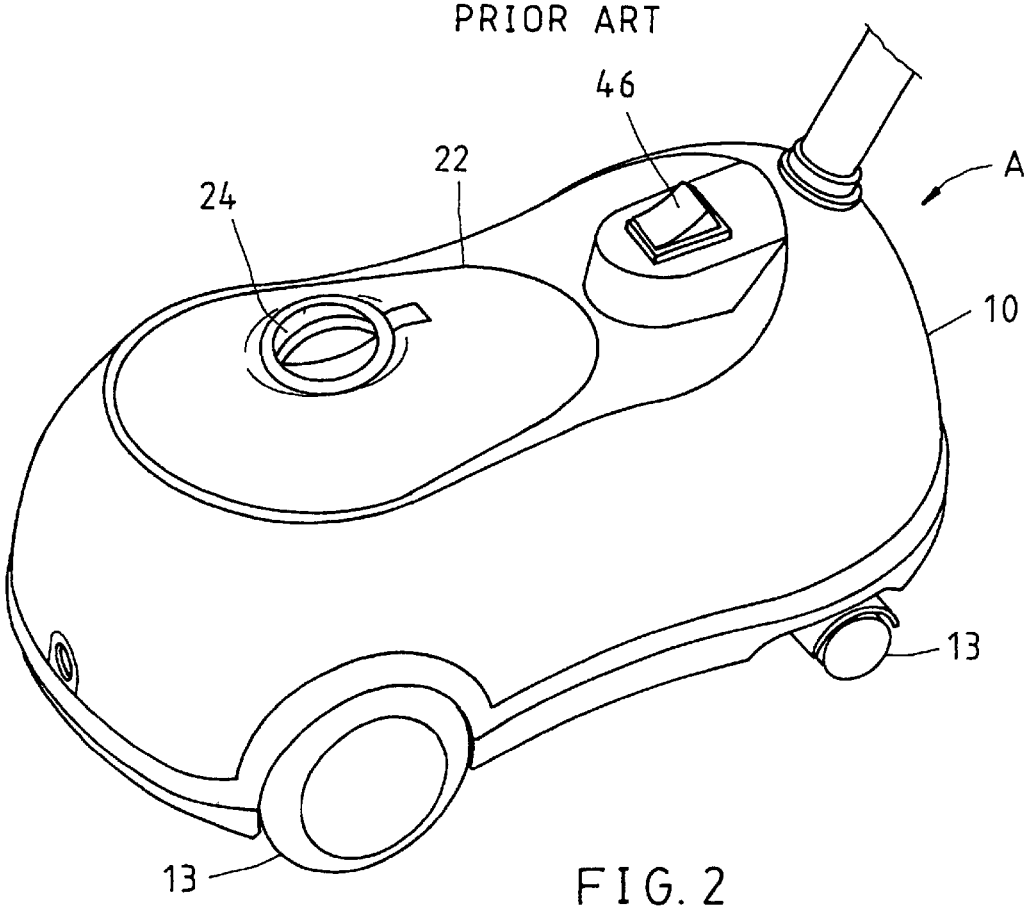
FIG. 2 shows a side sectional view of a preferred embodiment of the present invention.
Figure 3:
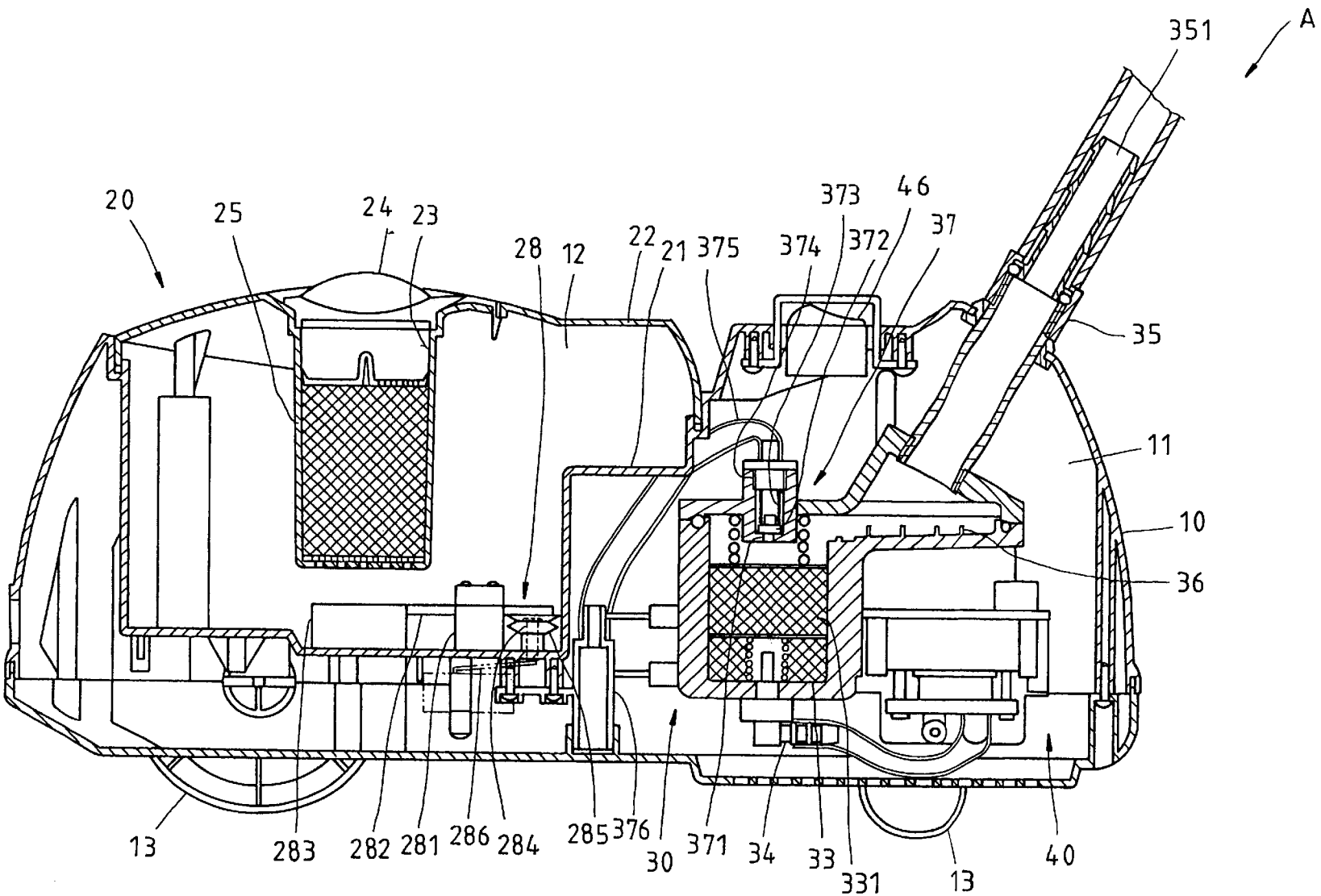
FIG. 3 shows a bottom sectional view of the preferred embodiment of the present invention.

As shown in FIGS. 2–3, a steam ironing machine of the preferred embodiment of the present invention comprises a main body 10, a boiler 20, and a water tank set 30.

The main body 10 comprises a receiving slot 11 located in the interior of the main body 10 for receiving the water tank set 30 and the boiler 20. The main body 10 is provided with an opening 12 in communication with the receiving slot 11. The main body 10 is provided with two wheels 13 which are pivoted to the underside of the main body 10. The main body 10 can be thus moved on the two wheels 13.

The boiler 20 is electrically operated to generate steam which is sent out via an aluminum pipe 21. The boiler 20 is provided with a water inlet 22 which is located in the bottom of the boiler 20 for introducing water into the boiler 20.

Figure 4:
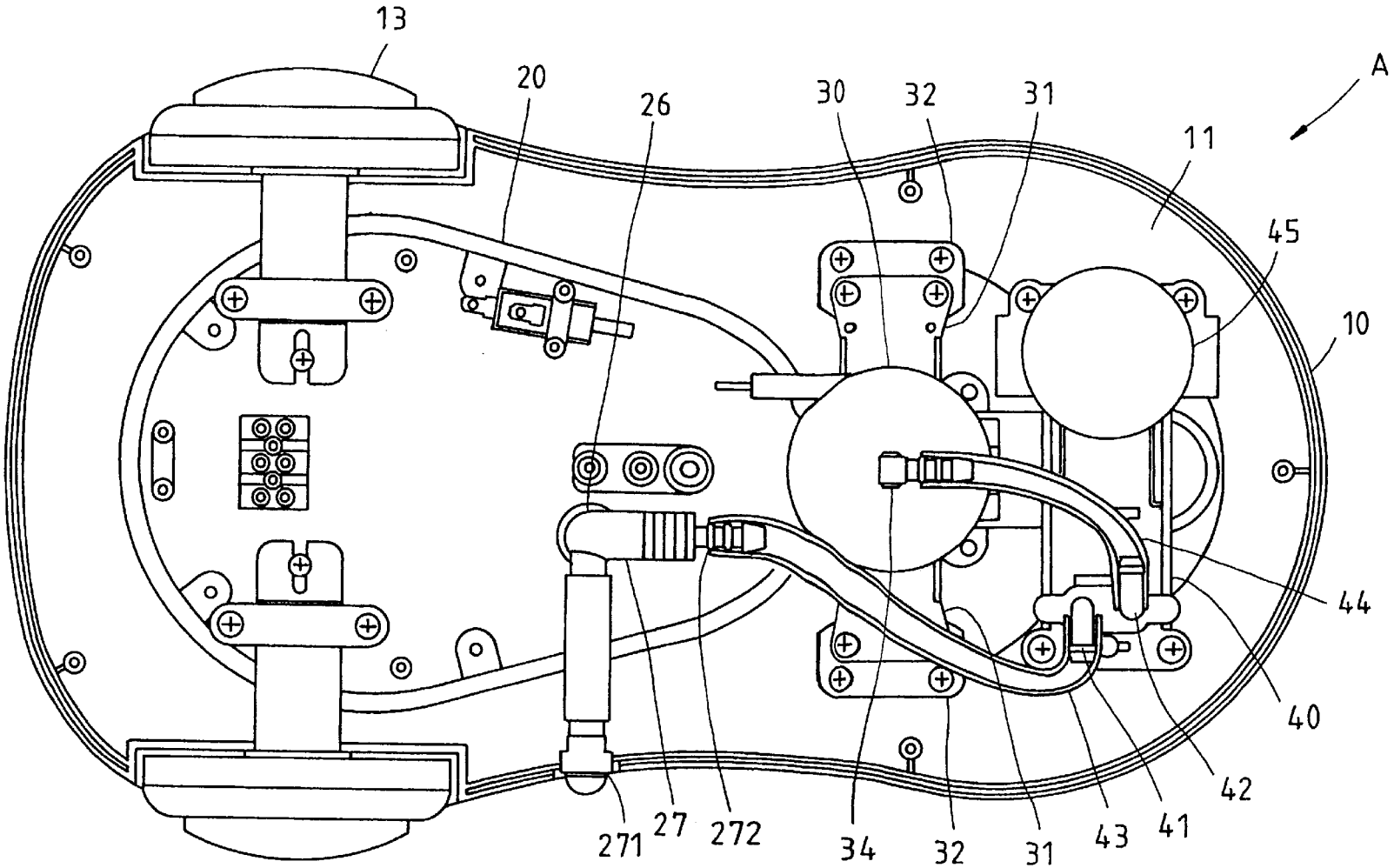
FIG. 4 shows a partial schematic view of the preferred embodiment of the present invention in action.
Figure 5:
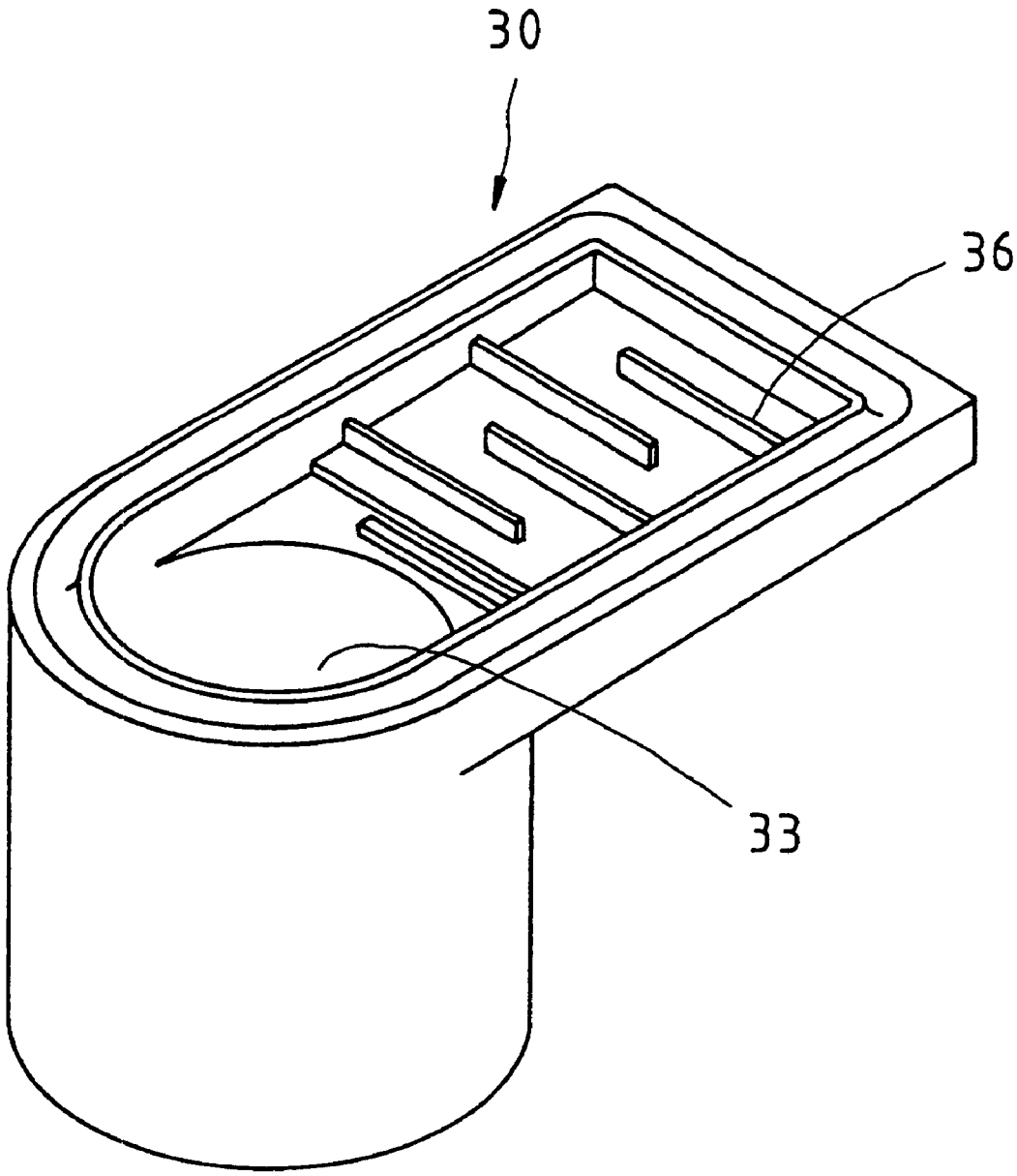
FIG. 5 shows another partial schematic view of the preferred embodiment of the present invention in action.

The water tank set 30 comprises a water storage tank 31 of a U-shaped construction and extending from the opening 12 of the main body 10 toward the inside of the receiving slot 11. The opening 12 is covered by a cap 32 which is provided with a water-adding port 321 in communication with the water storage tank 31. The water is let into the water storage tank 11 via the water adding port 321 which is provided with a cover 33 for covering the port 321, and a U-shaped filter 34 for removing impurities from the water flowing through the port 321. A water-discharging port 35 is located at the bottom of the water storage tank 31. A three-way connector 36 is located under the water storage tank 31 and is connected with the water-discharging port 35, a water-draining switch 361, and a water outlet connector 362. The water is discharged by the water-discharging port 35. The water outlet connector 362 is connected to a pump 40 by a first connection pipe 363. The water is pumped by the pump 40 from the water storage tank 31 to the boiler 20 via a second connection pipe 41 which is connected with the water inlet 22 of the boiler 20. The water storage tank 31 is provided in the bottom with a water level safety device 37 which is formed of a base rod 371 fastened at one end with the bottom of the water storage tank 31. A support rod 372 is fastened pivotally at the midsegment thereof with the base rod 371 and is provided at one end with a floating cylinder 373. The support rod 372 is provided at other end with a push rod 374 which penetrates the bottom of the water storage tank 31 and is provided with a sealing sleeve 375 fitted thereover for preventing the water leak. A valve switch 376 is disposed under the water storage tank 31 and is serially connected with a circuit. As shown in FIG. 4, when water level in the water storage tank 31 is higher than the floating cylinder 373, the floating cylinder 373 rises to press the push rod 374 of other end of the support rod 372 such that the push rod 374 is jutted out of the water storage tank 31 to come in contact with the valve switch 376, so as to activate the machine. As shown in FIG. 5, when the water level in the water storage tank 31 is lower than the floating cylinder 373, the floating cylinder 373 descends. As a result, the push rod 374 rises to move away from the valve switch 376, thereby resulting in power interruption to provide protection against the overheating of the boiler 20 which is devoid of water.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A safety structure of a steam ironing machine, comprising:

a main body having a receiving slot;

a boiler located in said receiving slot for generating steam; and a water tank set disposed in said receiving slot and formed of a water storage tank and a water level safety device, said water storage tank being in communication with said boiler, said water level safety device comprising a base rod, a support rod, and a valve switch, said base rod being fastened with said water storage tank, said support rod being pivoted to said base rod and provided at one end with a floating cylinder and at other end with a push rod, said valve switch being disposed under said push rod and being serially connected with a circuit, said floating cylinder being caused to rise to press said push rod to come in contact with said valve switch to activate the steam ironing machine at such time when water level in said water storage tank is higher than said floating cylinder, said push rod being caused to rise to move away from said valve switch to bring about a power interruption to the steam ironing machine at such time when water level in said water storage tank is lower than said floating cylinder.

2. The safety structure as defined in claim 1, wherein said push rod penetrates the bottom of said water storage tank and is provided with a sealing sleeve fitted thereover to prevent water leak.

3. The safety structure as defined in claim 1, wherein said base rod is disposed at the bottom of said water storage tank.

4. The safety structure as defined in claim 1, wherein water in said water storage tank is transported to said boiler by a pump.

* * * * *